US006569033B2

(12) United States Patent
Kosmatka

(10) Patent No.: US 6,569,033 B2
(45) **Date of Patent: *May 27, 2003**

(54) STRIKING PLATE FOR A GOLF CLUB HEAD

(75) Inventor: John B. Kosmatka, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/683,057

(22) Filed: Nov. 13, 2001

(65) Prior Publication Data

US 2002/0049094 A1 Apr. 25, 2002

Related U.S. Application Data

(63) Continuation-in-part of application No. 09/475,752, filed on Dec. 30, 1999, now Pat. No. 6,338,683, which is a continuation-in-part of application No. 09/454,695, filed on Dec. 3, 1999, now Pat. No. 6,471,603, which is a continuation of application No. 09/120,433, filed on Jul. 22, 1998, now Pat. No. 6,007,432, which is a continuation of application No. 08/735,601, filed on Oct. 23, 1996, now Pat. No. 5,830,084.

(51) Int. Cl.[7] ..... A63B 53/04

(52) U.S. Cl. ..... 473/329; 473/345; 473/349; 473/342

(58) Field of Search ..... 473/324, 329, 473/330, 345, 346, 342, 349, 350, 347, 348, 290, 291, 292, 332

(56) References Cited

U.S. PATENT DOCUMENTS

| | | | |
|---|---|---|---|
| 3,751,035 A | | 8/1973 | Lockwood |
| 3,937,474 A | | 2/1976 | Jepson et al. |
| 3,975,023 A | | 8/1976 | Inamori |
| 3,989,248 A | | 11/1976 | Campau |
| 4,252,262 A | | 2/1981 | Igarashi |
| 4,326,716 A | | 4/1982 | LaCoste |
| 4,398,965 A | | 8/1983 | Campau |
| 4,498,672 A | | 2/1985 | Bulla |
| 4,824,110 A | | 4/1989 | Kobayashi |
| 5,163,682 A | | 11/1992 | Schmidt et al. |
| 5,261,663 A | | 11/1993 | Anderson |
| 5,299,807 A | | 4/1994 | Hutin |
| 5,310,185 A | | 5/1994 | Viollaz et al. |
| 5,417,419 A | | 5/1995 | Anderson et al. |
| 5,431,396 A | | 7/1995 | Shieh |
| 5,458,334 A | | 10/1995 | Sheldon et al. |
| 5,460,371 A | | 10/1995 | Takeda |
| 5,494,281 A | | 2/1996 | Chen |
| 5,499,814 A | | 3/1996 | Lu |
| 5,505,453 A | | 4/1996 | Mack |
| 5,524,331 A | | 6/1996 | Pond |
| 5,573,467 A | | 11/1996 | Chou et al. |
| 5,586,948 A | | 12/1996 | Mick |
| 5,703,294 A | | 12/1997 | McConnell et al. |
| 5,743,813 A | | 4/1998 | Chen et al. |
| 5,766,094 A | | 6/1998 | Mahaffey et al. |
| 5,776,011 A | | 7/1998 | Su et al. |
| 5,797,807 A | | 8/1998 | Moore |
| 5,803,827 A | | 9/1998 | Kuykendall |
| 5,830,084 A | | 11/1998 | Kosmatka |
| 5,839,975 A | * | 11/1998 | Lundberg |
| 5,863,261 A | | 1/1999 | Eggiman |
| 5,873,791 A | | 2/1999 | Allen |
| 5,888,148 A | | 3/1999 | Allen |
| 5,954,596 A | | 9/1999 | Noble et al. |
| 6,007,432 A | | 12/1999 | Kosmatka |
| 6,048,278 A | | 4/2000 | Meyer et al. |
| 6,162,133 A | * | 12/2000 | Peterson |
| 6,248,025 B1 | * | 6/2001 | Murphy et al. |
| 6,338,683 B1 | * | 1/2002 | Kosmatka |

* cited by examiner

*Primary Examiner*—Sebastiano Passaniti
(74) *Attorney, Agent, or Firm*—Michael A. Catania

(57) ABSTRACT

A golf club having a club head with a striking plate that has an aspect ratio in excess of 0.575. The golf club head has a thin striking plate with a high aspect ratio in order to increase the deflection of the striking plate during impact with a golf ball. The striking plate may be composed of stainless steel, titanium, aluminum, amorphous metal, composites, or the like. The golf club head may be a wood or an iron.

5 Claims, 12 Drawing Sheets

STRIKING PLATE FOR A GOLF CLUB HEAD

CROSS REFERENCE TO RELATED APPLICATIONS

This application is a continuation-in-part application of U.S. patent application Ser. No., 09/475,752, filed on Dec. 30,1999, now U.S. Pat. No. 6,338,683, which is a continuation-in-part application of U.S. patent application Ser. No. 09/454,695, filed on Dec. 3, 1999, now U.S. Pat. No. 6,471,603 which is a continuation application of U.S. patent application Ser. No. 09/120,433 filed on Jul. 22, 1998 now U.S. Pat. No. 6,007,432, which is a continuation application of U.S. patent application Ser. No. 08/735,601, filed on Oct. 23, 1996, now U.S. Pat. No. 5,830,084.

FEDERAL RESEARCH STATEMENT

Not Applicable

BACKGROUND OF INVENTION

1. Field of the Invention

The present invention relates to a golf club head. More specifically, the present invention relates to a golf club head with a striking plate having a more circular aspect ratio.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inches), as opposed to the small deformations of the metallic club face (0.025 to 0.050 inches). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although the prior art has disclosed many variations of golf club heads, the prior art has failed to provide a golf club head having a striking plate that increases the coefficient of restitution through increasing the depth of the striking plate.

SUMMARY OF INVENTION

The present invention provides a golf club head that is capable of imparting a very high coefficient of restitution. The present invention is able to accomplish this by using a striking plate having an increased depth, and a predetermined stiffness.

One aspect of the present invention is a golf club head with a striking plate that has an aspect ratio in excess of 0.575. The striking plate also has a depth within a certain range, and a width within a certain range. This allows the striking plate to have a greater deflection during impact with a golf ball thereby allowing for a greater transfer of energy to the golf ball. This energy transfer results in a golf club having a high coefficient of restitution. The coefficient of restitution is measured under test conditions, such as those specified by the USGA. The standard USGA conditions for measuring the coefficient of restitution is set forth in the *USGA Procedure for Measuring the Velocity Ratio of a Club Head for Conformance to Rule* 4–1e, *Appendix II. Revision I,* Aug. 4, 1998 and Revision 0, July 6, 7998, available from the USGA.

Having briefly described the present invention, the above and further objects, features and advantages thereof will be recognized by those skilled in the pertinent art from the following detailed description of the invention when taken in conjunction with the accompanying drawings.

DETAILED DESCRIPTION

The present invention is directed at a golf club head having a striking plate that is thin and has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. COR ranges refer to USGA test standards. The present invention provides a club head having a striking plate or face with a coefficient preferably in the range of 0.81 to 0.93, and more preferably in the range of 0.82 to 0.85 as measured under conventional USGA test conditions.

Figure 1:
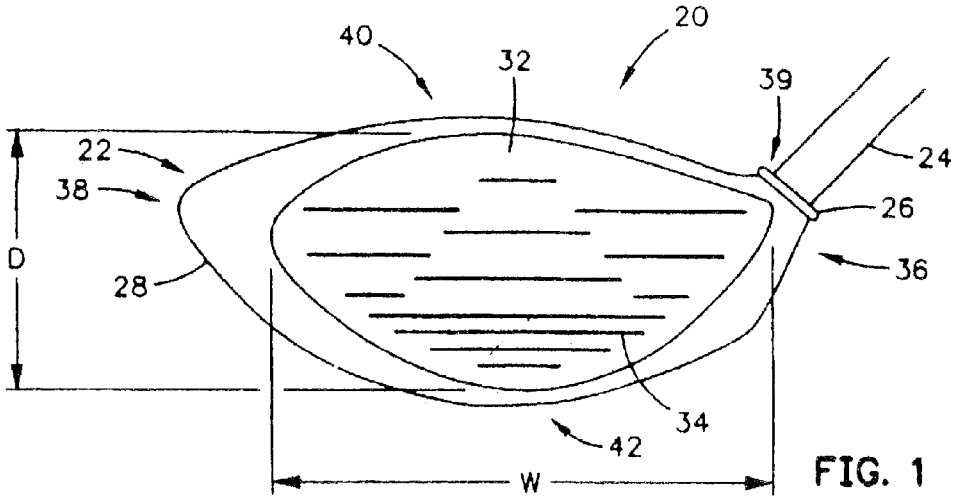
FIG. 1 is a front plan view of a golf club of the present invention.
Figure 2:
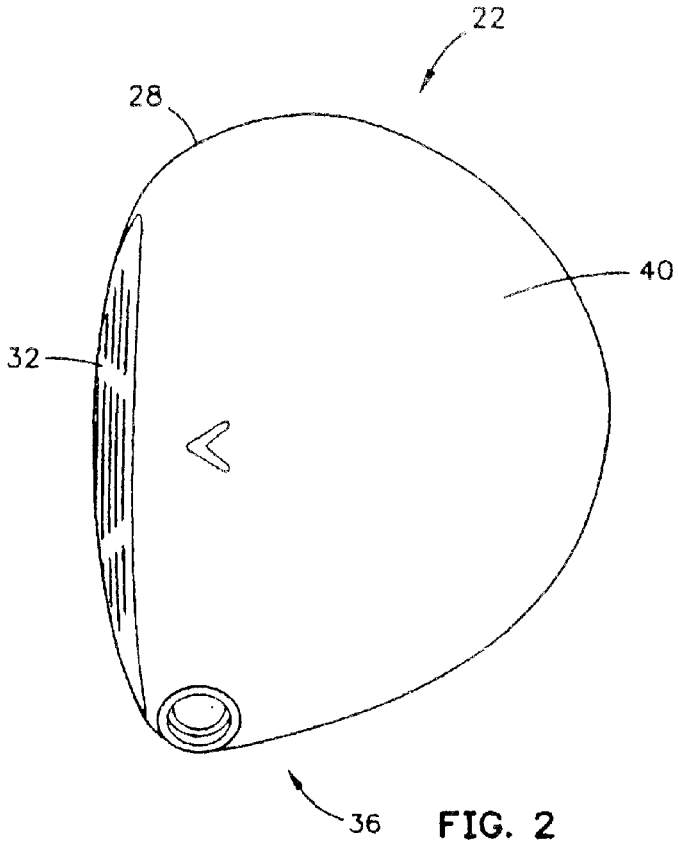
FIG. 2 is a top plan view of the golf club head of FIG. 1.
Figure 3:
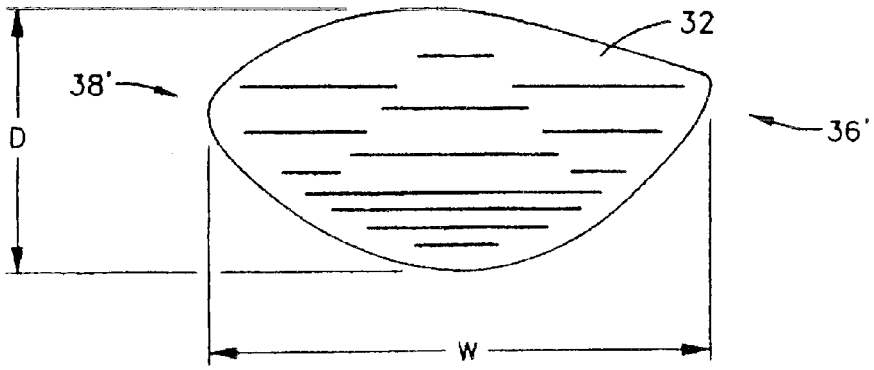
FIG. 3 is an isolated view of a striking plate for a golf club head of the present invention.
Figure 4:
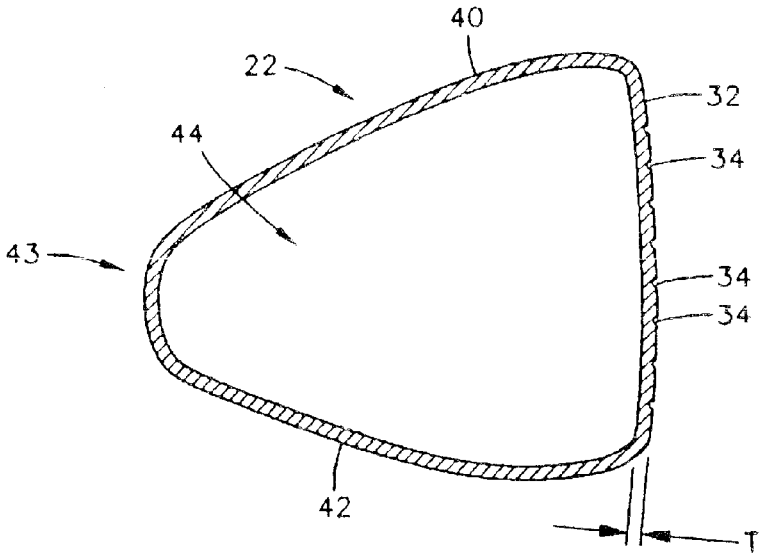
FIG. 4 is a cross-sectional view of the golf club head of FIG. 2 along line 4—4.

As shown in FIGS. 1–4, a preferred golf club is generally designated 20. The golf club 20 has a club head 22 that is engaged with a shaft 24. A ferrule 26 encircles the shaft 24 at an aperture 27 to a hosel 29. The club head 22 has a body 28 and a striking plate 32. The striking plate 32 has a plurality of scorelines 34 thereon. The striking plate 32 generally extends from a heel end 36 of the club head 22 to a toe end 38 of the club head 22. The body 28 has a crown 40 and a sole 42. As shown in FIG. 4, the body 28 has a hollow interior 44. Positioned inside the hollow interior 44 is the hosel 29. The club head body 28 has a volume preferably in the range of 250 cubic centimeters to 400 cubic centimeters and more preferably in the range of 300 cubic centimeters to 380 cubic centimeters.

The striking plate 32 is generally composed of a single piece of metal, and is preferably composed of a forged metal material. More preferably, the forged metal material is a forged titanium material. Such titanium materials include pure titanium and titanium alloys. However, alternative embodiments including steel such as stainless steel or steel alloys may also be used. Those skilled in the relevant art will recognize that the face member may be composed of a number of alternative embodiments such as vitreous metals, ceramics, composites, carbon, carbon fibers and other fibrous materials without departing from the scope and spirit of the present invention. The striking plate 32 has a plurality of scorelines 34 thereon. The striking plate 32 may be cast with the body 28, or it may be welded to the body 28.

In an alternative embodiment, the striking plate 32 is composed of a vitreous metal such as iron-boron, nickel-copper, nickel-zirconium, nickel-phosphorous, and the like. These vitreous metals allow for the striking plate 32 to have a thickness as thin as 0.055 inches. Yet in further alternative embodiments, the striking plate 32 is composed of ceramics, composites or other metals. Additionally, the thinnest regions of the striking plate 32 may be as low as 0.010 inches allowing for greater compliance and thus a higher coefficient of restitution.

The striking plate 32 of the present invention has a larger aspect ratio than striking plates of the prior art. The aspect ratio as used herein is defined as the depth, D, of the striking plate 32 divided by the width, W, of the striking plate, as shown in FIG. 3. The width, W, is measured between the farthest limits of the striking plate 32 from the heel end 36 to the toe end 38. The measured width, W, does not include any portion of the body 28 that may be on the front of the club head 22 but not part of the striking plate 32. The depth, D, is measured from between the farthest limits of the striking plate 32 from the crown 40 to the sole 42. As with the width, W, the depth, D, does not include any portion of the body 28 that may be on the front of the club head 22 but not part of the striking plate 32.

In one embodiment, the width W is 3.35 inches and the depth D is 2.0 inches giving an aspect ratio of 0.6. In conventional golf club heads, the aspect ratio is usually much lower than 0.6. For example, the original GREAT BIG BERTHA® driver had an aspect ratio of approximately 0.525 for its striking plate. The striking plate 32 of the present invention has an aspect ratio that is greater than 0.575. The aspect ratio of the present invention preferably ranges from 0.575 to 0.8, and is most preferably from 0.6 to 0.7. The aspect ratio of the striking plate 32 will be described in greater detail below.

Figure 5:
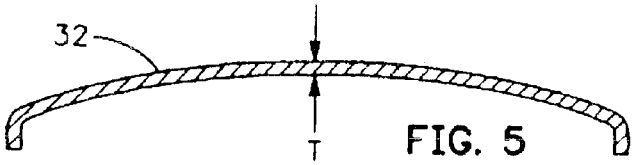
FIG. 5 is an isolated view of the striking plate of FIG. 3.
Figure 6:
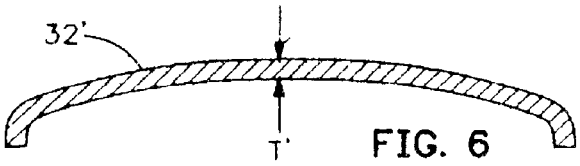
FIG. 6 (PRIOR ART)
FIG. 6 is an isolated view of a striking plate of the prior art.
Figure 7:
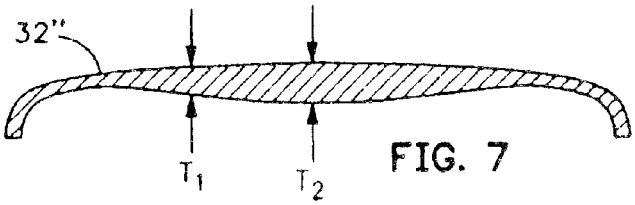
FIG. 7 is an isolated view of an alternative embodiment of a striking plate of the present invention.
Figure 8:
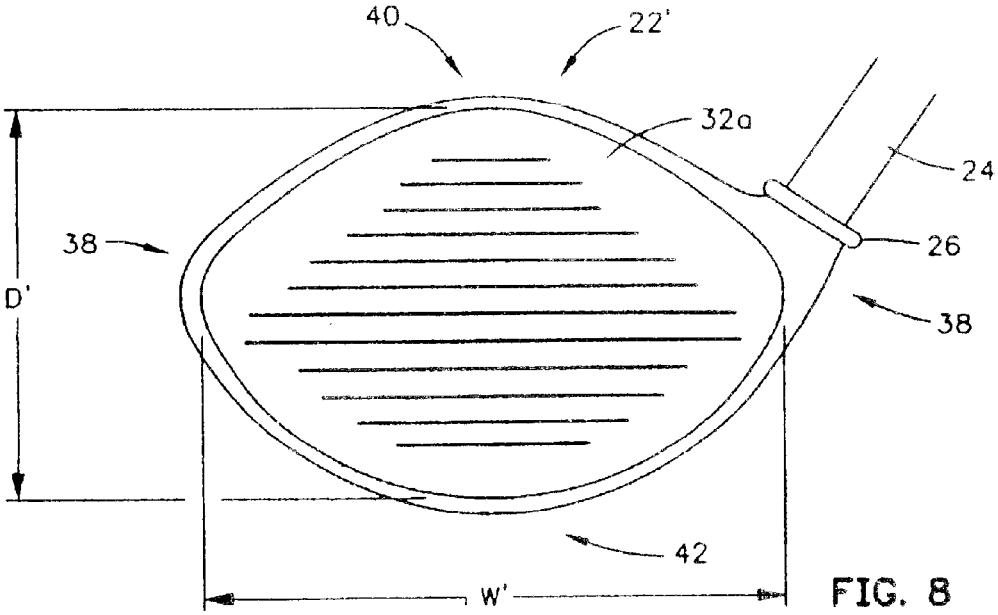
FIG. 8 is a front plan view of an alternative embodiment of a golf club of the present invention.

As shown in FIGS. 4, 5 and 6, the thickness, "T", of the striking plate 32 may be uniform or it may be contoured as set forth in U.S. Pat. No. 6,007,432 for a Contoured Golf Club Face, which relevant parts are hereby incorporated by reference. However, unlike the striking plate 32' of the prior art (as shown in FIG. 6), the striking plate 32 has a thickness, T, that is thinner providing for greater deflection of the striking plate 32 during impact with a golf ball. In a contoured striking plate 32, the thickness varies from a first thickness T1 to at least a second thickness T2. The thickness, T, of the striking plate 32 in relation to the aspect ratio is preferably in the range of 0.050 inch to 0.130 inch and is more preferably in the range of 0.100 to 0.110.

Figure 9:
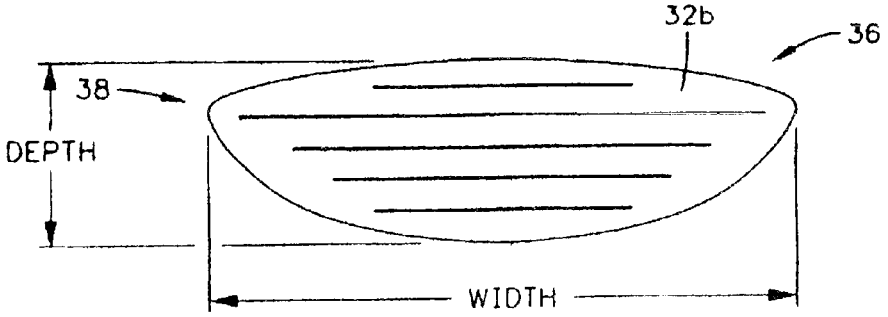
FIG. 9 is an isolated view of an alternative embodiment of a striking plate of the present invention.
Figure 10:
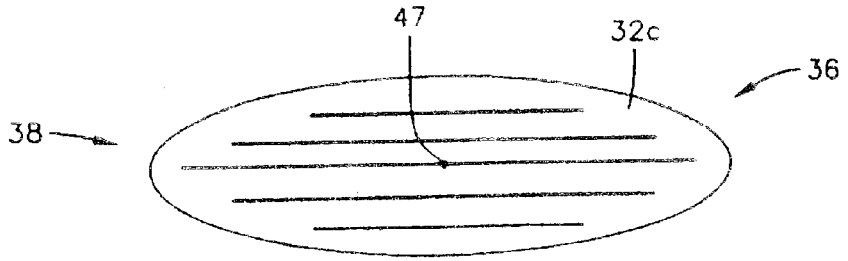
FIG. 10 is an isolated view of an alternative embodiment of a striking plate of the present invention.
Figure 11:
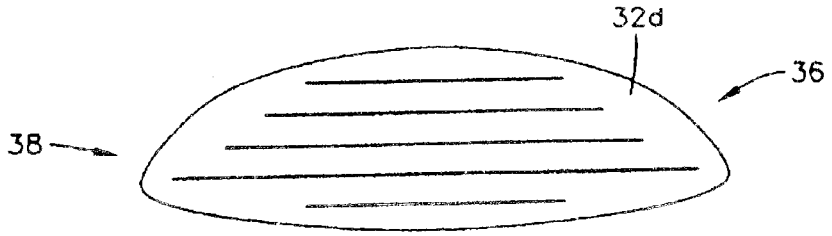
FIG. 11 is an isolated view of an alternative embodiment of a striking plate of the present invention.

A golf club head 22' is an alternative embodiment of the present invention. In this embodiment, the striking plate 32*a* has a much more circular aspect ratio. In this embodiment, the aspect ratio is approximately 0.8. FIGS. 9–10 illustrate various types of striking plates 32*b*, 32*c* and 32*d*, respectively, that may be utilized with the present invention. The striking plate 32*b* of FIG. 9 has a traditional or conventional shape. The striking plate 32*c* of FIG. 10 has a non-conventional oval shape with symmetry about an imaginary central axis through point 47. The striking plate 32*d* of FIG. 11 has an inverted shape from the conventional shape of FIG. 9. Although several shapes of striking plates have been illustrated, those skilled in the pertinent art will recognize that striking plates having other shapes are within the scope and spirit of the present invention.

Figure 12:
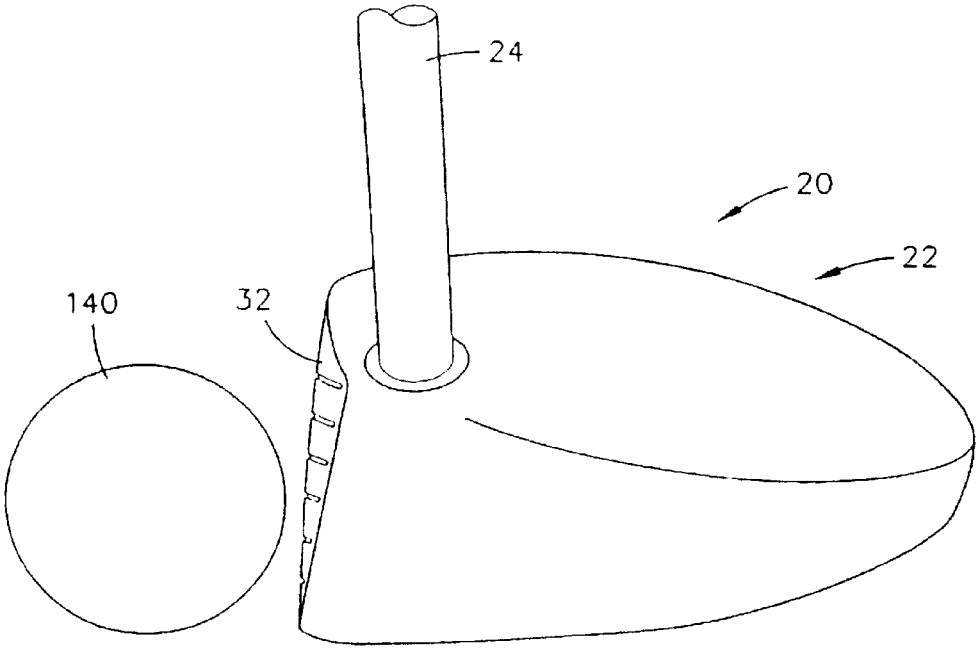
FIG. 12 is a side view of a golf club head of the present invention immediately prior to impact with a golf ball.
Figure 13:
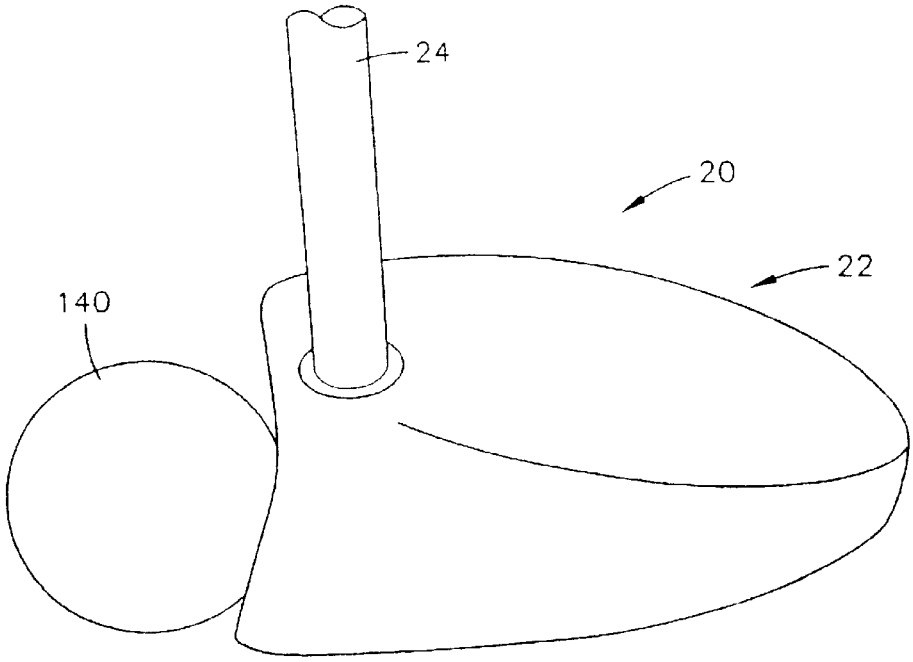
FIG. 13 is a side view of a golf club head of the present invention during impact with a golf ball.
Figure 14:
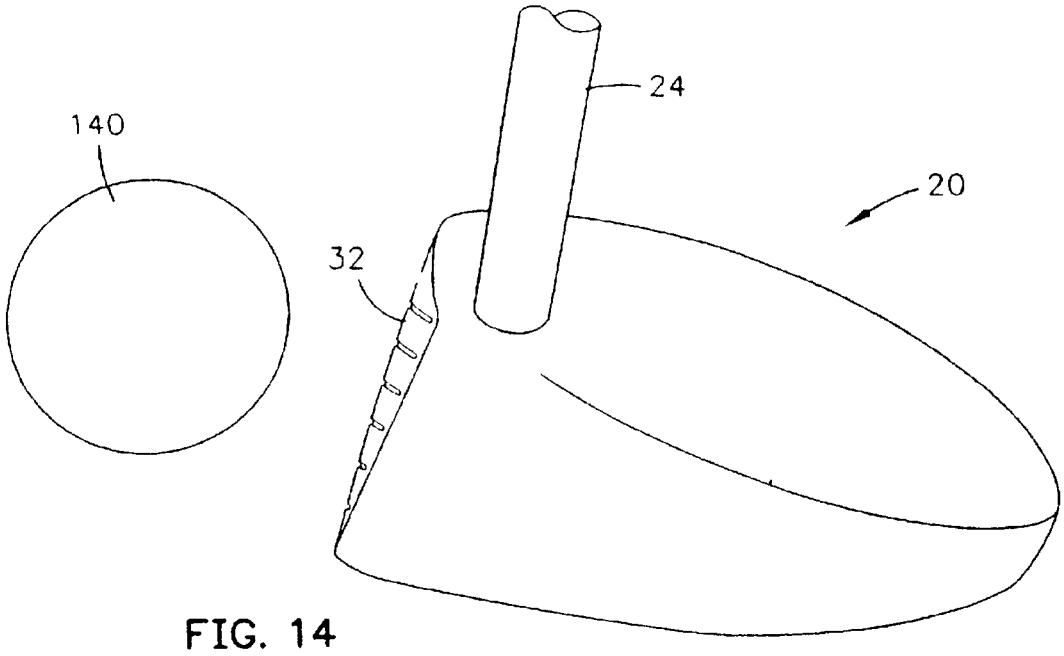
FIG. 14 is a side view of a golf club head of the present invention immediately after impact with a golf ball.

As shown in FIGS. 12–14, the flexibility of the striking plate 32 allows for a greater coefficient of restitution thereby increasing the performance of the golf club 20. At FIG. 12, the striking plate 26 is immediately prior to striking a golf ball 140. At FIG. 13, the striking plate 26 is engaging the golf ball 140, and deformation of the golf ball 140 and striking plate 26 is illustrated. The striking plate 26 is allowed to deflect about the golf ball 140 thereby lessening the deformation of the golf ball 140 relative to prior art. The golf ball 140 is also engaged with the striking plate 26 for a longer period of time due to the deflection of the striking plate. This longer engagement period leads to a greater transfer of energy from the golf club to the golf ball thereby increasing the coefficient of restitution. At FIG. 14, the golf ball 140 has just been launched from the striking plate 26.

Figure 15:
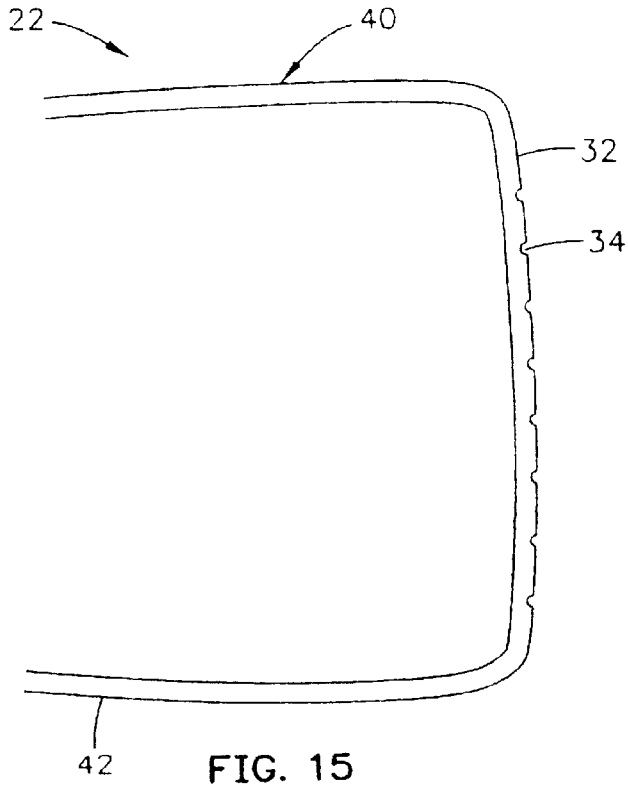
FIG. 15 is a cross-sectional view of a golf club head of the present invention.
Figure 15A:
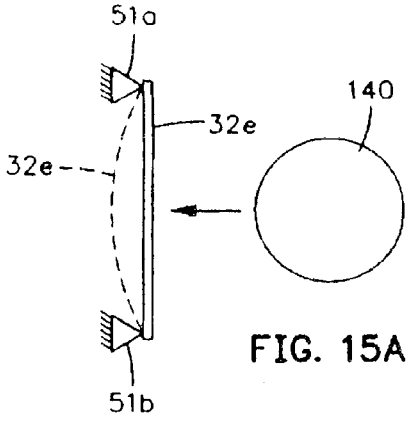
FIG. 15A is a representation of a striking plate simply supported to illustrate one extreme of striking plate deflection during impact with a golf ball.
Figure 15B:
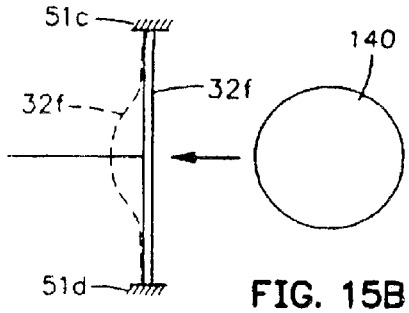
FIG. 15B is a representation of a striking plate fixedly supported to illustrate the other extreme of striking plate deflection during impact with a golf ball.

FIG. 15 illustrates the striking plate 32 and the plurality of scorelines 34. Each of the plurality of scorelines 34 may act as a stress concentrator during impact with a golf ball. Like other striking plates of the prior art, the striking plate 32 of the present invention is positioned between the crown 40 and sole 42. During impact with a golf ball, the striking plate 32 will deflect depending upon the connection to the crown 40 and the sole 42. FIGS. 15*a* and 15B illustrate the extremes of such connection, and thus every golf club striking plate that is connected to the crown and the sole should fall within these two extremes. FIG. 15A illustrates a striking plate 32*e* that is simply supported on two beams 51*a* and 51*b*. Such a simple support structure will allow each edge of the striking plate 32*e* to rotate during impact with a golf ball 140 and deflect as shown by dashed lines 32*e'*. However, each edge of the striking plate 32*e* is fixed from translation. At the other extreme is the striking plate 32*f* of FIG. 15*b*, which is essentially clamped between beams 51*c* and 51*d*. Depending upon the speed at impact with a golf ball, the fixed striking plate 32*f* will deflect as shown by dashed lines 32*f'*. However, each edge of the striking plate 32*f* is fixed from translating and rotating. The striking plates 32 of the present invention are closer to the simple support structure than to the fixed structure.

Figure 16:
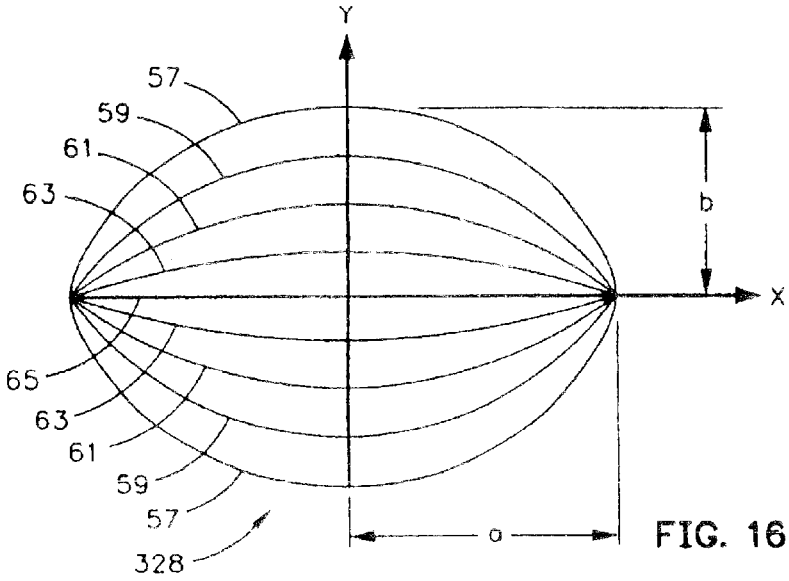
FIG. 16 is a representation of a striking plate to demonstrate the possible increases in depth relative to a fixed width.

FIG. 16 illustrates possible elliptical shapes 57, 59, 61, 63 and 65 that a striking plate 32*g* may have by increasing the depth, D, along the y-axis while holding the width, W, constant. The half-width distance "a" (a=W/2) is usually constant for most golf clubs, however, the half-depth distance, "b" (b=D/2), has been limited to relatively small values. The present invention increases b relative to the prior art to create a striking plate 32 with a more circular aspect ratio. The aspect ratio, $\alpha$=b/a, varies between zero and one, with one being a circle. The present invention, as mentioned previously, has a striking plate 32 with an aspect ratio of at least 0.575. The striking plate 32 of the present invention is able to achieve greater flexibility and thus improve energy transfer to the golf ball during impact by increasing the aspect ratio of the striking plate 32.

The weight or mass of the striking plate 32 linearly increases as the aspect ratio increases as set forth in the following equation: mass=$\rho\pi Ta^2\alpha$ wherein $\rho$ is the weight or mass density of the material, T is the thickness of the striking plate 32, a is the half-width of the striking plate 32, and $\alpha$ is the aspect ratio. Thus, the striking plate 32 should be thinner as the aspect ratio increases in order to avoid a heavy golf club.

Figure 17:
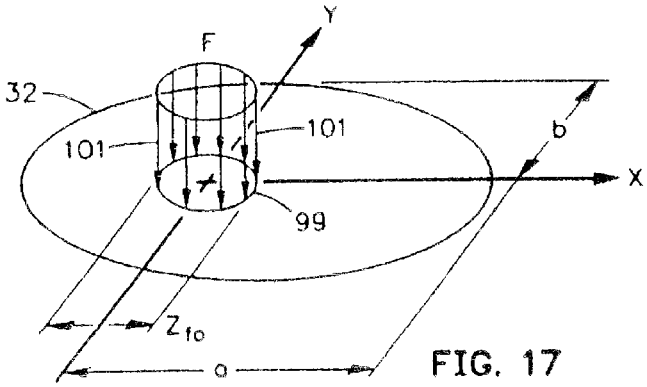
FIG. 17 is a representation of a striking plate to demonstrate a golf ball's impact force with the striking plate.

FIG. 17 illustrates the force against a striking plate 32 during impact with a golf ball. During impact with a golf ball, a uniform load, as shown by circle 99, will be applied to the striking plate 32, as shown by force lines 101. The force circle 99 has a radius of $r_o$, which ranges between 0.3 and 0.60 inches. Typical impacts of a driver with a golf ball will result in a force, F, ranging from 1500 to 2500 pounds per square inch. The force of impact is given by the equation:

$$F = \int_0^{2\pi}\int_0^{r_o} qr\,dr\,d\theta$$

where q is the pressure distribution over the impact area. The displacement of the simple support structure of FIG. 15A is given by the following equation:

$$\Delta = Fa^2\alpha^2/Et^3(0.76-0.18\alpha)$$

wherein E is the Young's Modulus for the material of the striking plate 32. The displacement of the fixed support structure of FIG. 15B is given by the following equation:

$$\Delta = Fa^2\alpha^2/Et^3(0.326-0.104\alpha)$$

wherein E is the Young's Modulus for the material of the striking plate 32. To increase the displacement, $\Delta$, of the striking plate 32 during impact for a given golf ball impact load, F, one may increase a, reduce E, decrease t or increase $\alpha$. Modifying t or $\alpha$ will have the greatest effect on the displacement, however, t is controlled by the materials as described below.

The effective stiffness at the center of the striking plate 32 is given by the equation:

$$K_{eff} = F_{center}/\Delta_{center} = Et^3/a^2\alpha^2(0.76-0.18\alpha)$$

for the simple structure, and $$K_{eff} = F_{center}/\Delta_{center} = Et^3/a^2\alpha^2(0.326-0.104\alpha)$$

for the fixed structure. Therefore, to decrease stiffness, one should reduce T, increase a, use a material with a lower E, or increase $\alpha$. Thus, the stiffness of the striking plate 32 is altered by increasing the aspect ratio thereby by allowing for greater deflection of the striking plate during impact with a golf ball.

The stress at the center of the striking plate 32 during impact with a golf ball is given by the equations:

$\sigma=3F(1+\nu)/2\pi t^2[\{In\ (2b/r0)-0.317\alpha-0.376\}]$ for the simple structure and $\sigma=3F/2\pi t^2[\{(1+\nu)\ \text{In}\ (b/r0)+\nu(6.57-2.57\alpha)\}]$ for the fixed structure, where ($\nu$) is the Poisson ratio of the striking plate 32 material. Solving for the minimum required thickness gives the following equations:

$$T=\sqrt{\frac{3F^*}{2\pi\sigma_{yeild}}\left[(1+\nu)\ln\left(\frac{b}{r_0}\right)+\nu(6.57-2.57\alpha)\right]},$$

for the simply-supported case and $$T=\sqrt{\frac{3F^*(1+\nu)}{2\pi\sigma_{yeild}}\left[\ln\left(\frac{2b}{r_0}\right)-.317\alpha-.376\right]},$$

for the fixed edge support case, where ($\sigma_{yield}$) is the strength of the striking plate 32 material, F* is the effective impact force that includes the effects of design safety factors and scoreline stress concentration factors and ranges between 2000 and 15,000 pounds for the striking plate 32 of the present invention.

The half-width, a, is between 1.25 and 2.0 inches for the striking plate 32 of the present invention. The aspect ratio, $\alpha$, is between 0.575 and 1.0 for the striking plate 32 of the present invention. Other values for materials of the striking plate 32 are set forth in Table One.

TABLE One

| Material | E $10^6$ lb/in$^2$ | $\nu$ | $\sigma$ yield $10^3$ lb/in$^2$ lb/in$^3$ | $\rho$ (weight density) | $\rho$ density) grams/in$^3$ |
|---|---|---|---|---|---|
| Stainless Steel | 29 | 0.27 | 150 | 0.28 | 126.93 |
| Titanium (6-4) | 16.5 | 0.31 | 115 | 0.16 | 72.53 |
| Aluminum | 10 | 0.333 | 73 | 0.101 | 45.78 |
| Maraging Steel | 28.4 | 0.3 | 280 | 0.28 | 126.93 |
| Liquid Metal | 13.3 | 0.3 | 260 | 0.22 | 99.73 |

FIGS. 18–22 demonstrates the features of the striking plate 32 of the present invention in light of prior art. The boxes on the graphs represent the prior art, and where these prior art golf club striking plates are positioned in relation to each other and the striking plate 32 of the present invention. Persimmon is a persimmon wood golf club of the prior art. GBB is a GREAT BIG BERTHA® driver available from Callaway Golf, BBB is a BIGGEST BIG BERTHA ® driver available from Callaway Golf, Orlimar is a Tri-Force driver from Orlimar Golf, Scud and Marumen represent drivers from these Japanese companies.

Figure 18:
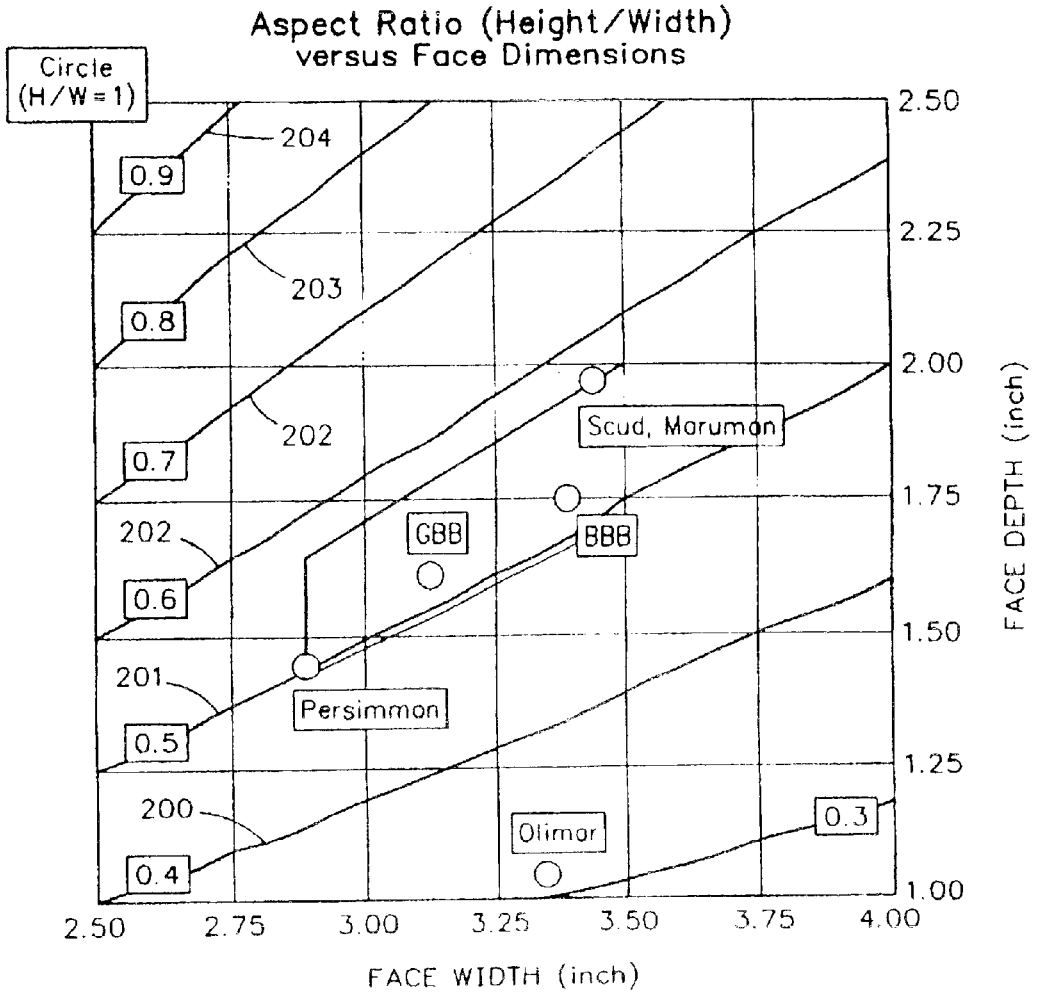
FIG. 18 is a graph of aspect ratio versus face dimensions.

FIG. 18 illustrates the aspect ratio of the striking plate versus the face dimensions of the striking plate. Lines 200–204 represent aspect ratio lines. The prior art golf club striking plates lie below an aspect ratio line of 0.575. The striking plates 32 of the present lie at or above an aspect ratio line of 0.575.

Figure 19:
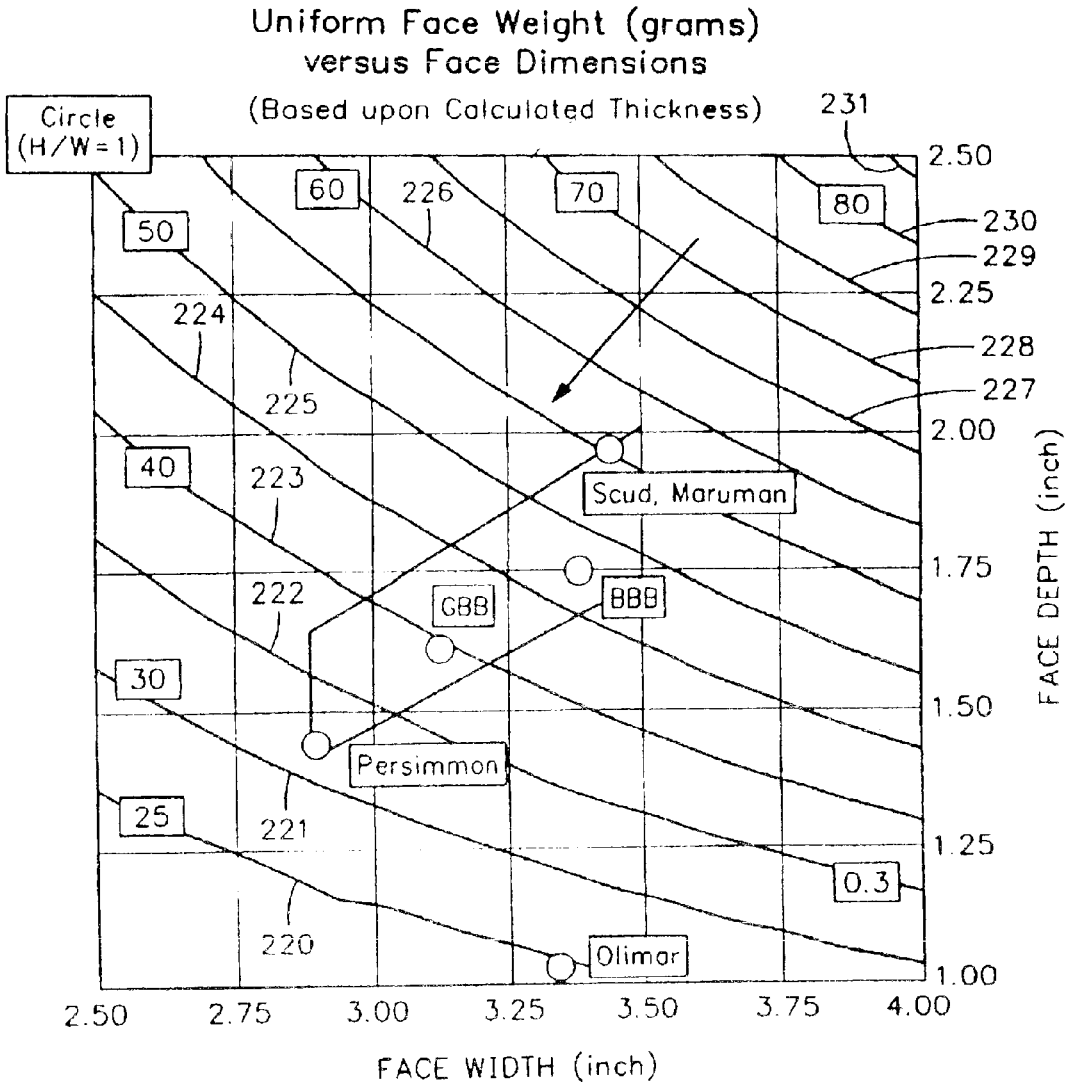
FIG. 19 is a graph of uniform face weight versus face dimensions.

FIG. 19 illustrates the weight or mass of a uniform thickness striking plate 32 versus the face dimensions. Lines 220–231 are lines of equal weight or mass. Generally, the striking plate of the present invention has a mass that is within lines 222 and 228, or in other terms, between 35 grams and 70 grams.

Figure 20:
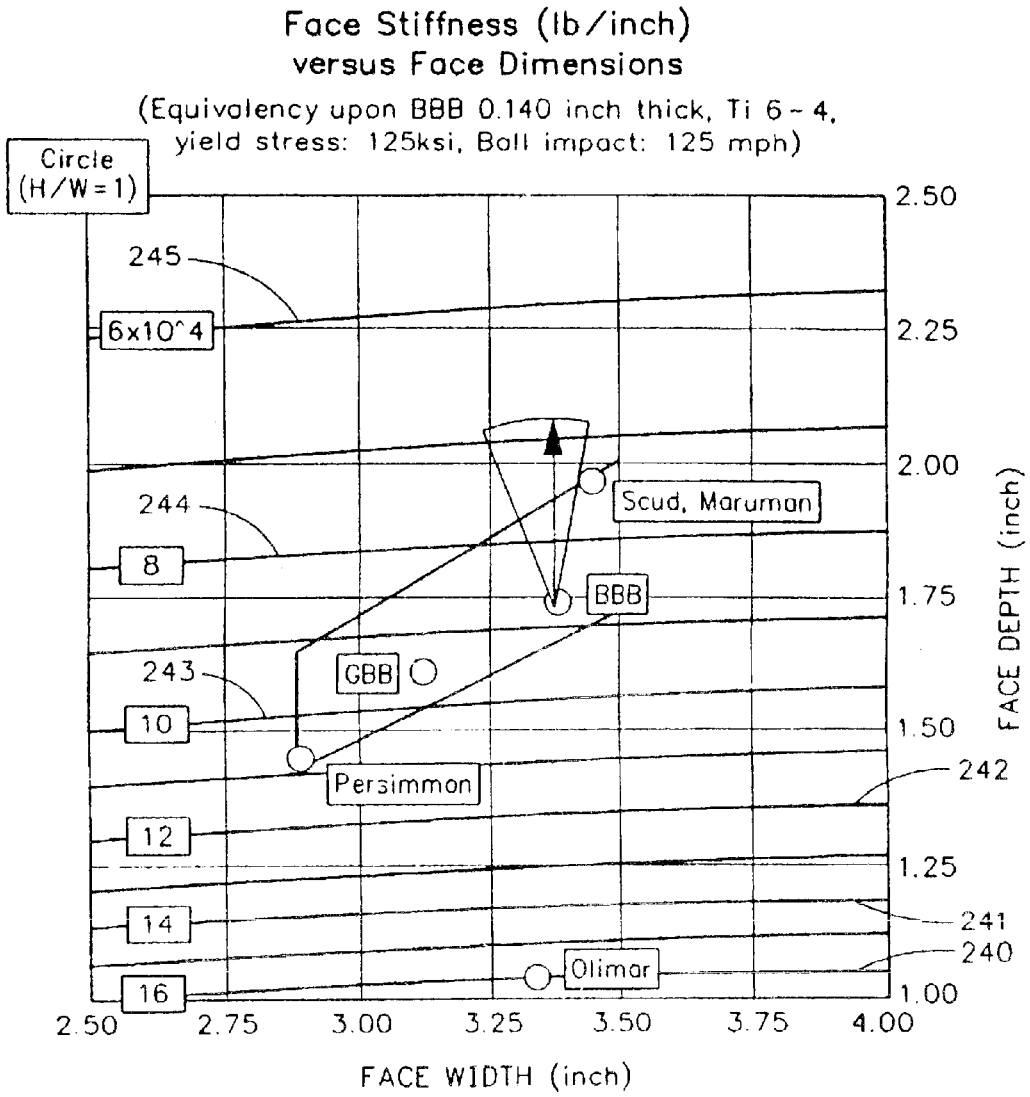
FIG. 20 is a graph of face stiffness versus face dimensions.

FIG. 20 illustrates the face stiffness versus the face dimensions. Lines 240–245 represent lines of equal stiffness. The striking plate 32 of the present invention has a face stiffness between lines 244 and 245.

Figure 21:
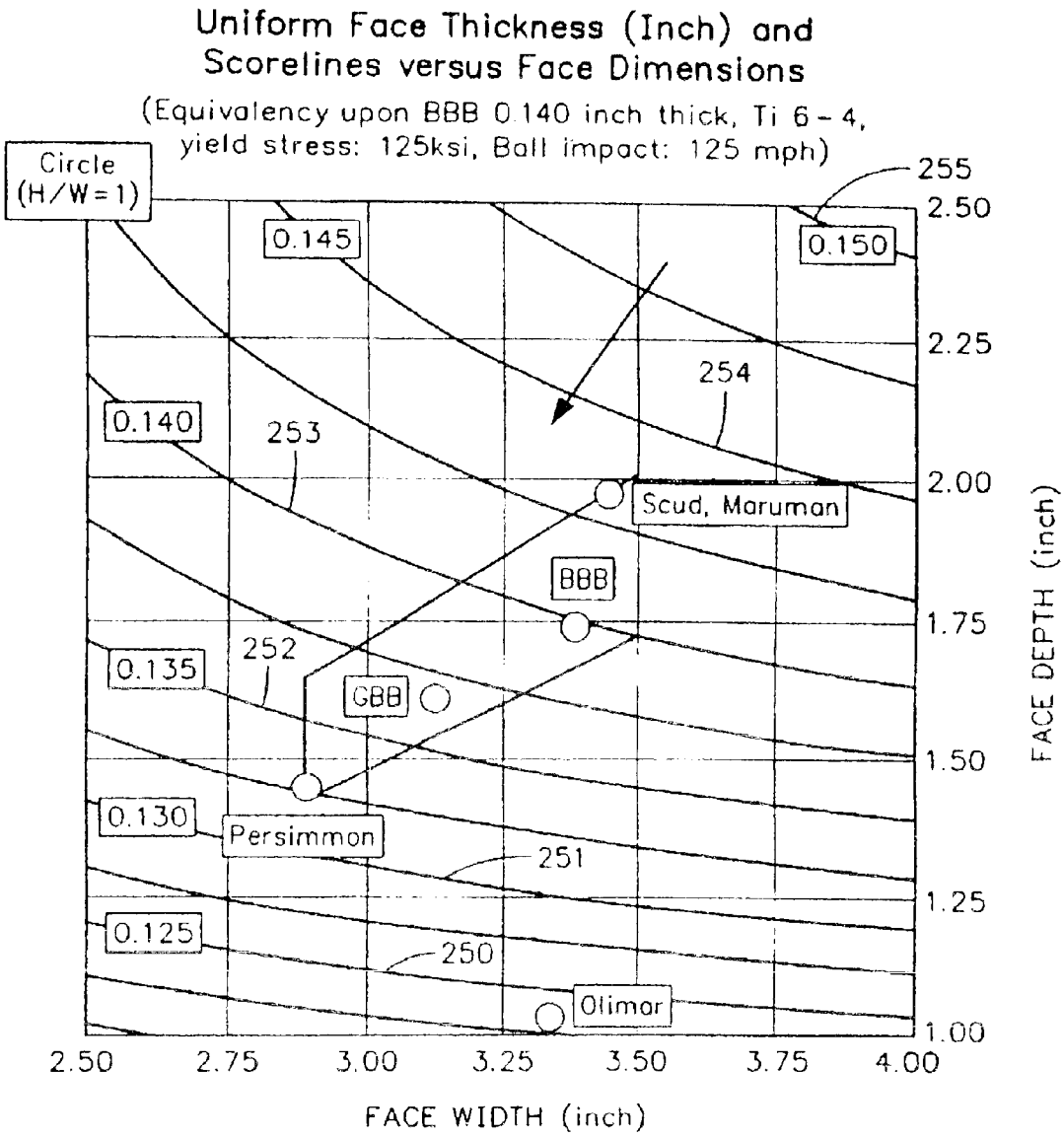
FIG. 21 is a graph of uniform face thickness versus face dimensions.

FIG. 21 illustrates face thickness and scorelines versus face dimensions. Lines 250–255 represent equal lines of face thickness. The striking plate 32 has a thickness in the range of 0.135 inches and 0.145 inches.

Figure 22:
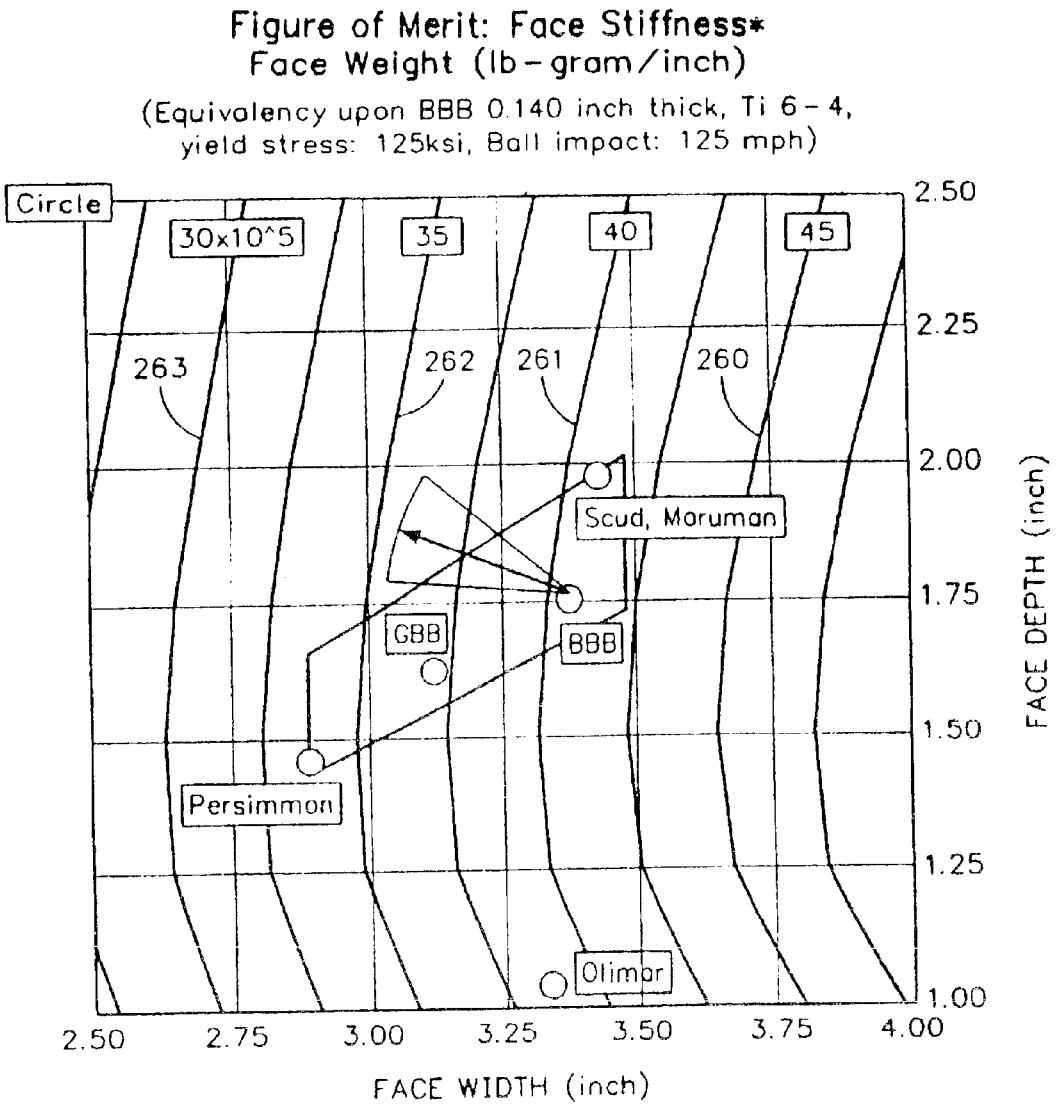
FIG. 22 is a graph of figure of merit.

FIG. 22 illustrates figure of merit which is face stiffness, multiplied by face mass versus the face dimensions. Lines 260–263 represent lines of equal merit. The present invention has a figure of merit in excess of 40.

Thus, using aspect ratio, stiffness, material properties, and the like, a golf club head of the present invention is designed to have greater deflection which results in a greater transfer of energy to a golf ball during impact thereby increasing the coefficient of restitution of the golf club head, and allowing for the golf ball to travel further.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf club head comprising:

a body having a heel end and a toe end wherein a striking plate is disposed on the body and extends from the heel end to the toe end, wherein the striking plate is composed of a forged titanium material having an exterior surface with a depth, D, of the striking plate ranging from 1.45 inches to 2.50 inches and a width, W, ranging from 2.50 inches to 4.00 inches, wherein the striking plate has an aspect ratio of at least 0.575, and a striking plate thickness, T, ranging from 0.050 inch to 0.130 inch, and wherein the body has a volume ranging from 250 cubic centimeters to 400 cubic centimeters and wherein the golf club head has a COR value ranging from 0.81 to 0.93 as measured under USGA test conditions.

2. The golf club head according to claim 1 wherein the striking plate has a thickness, T, in the range of 0.100 inch to 0.110 inch.

3. The golf club head according to claim 1 wherein the body has a volume in the range of 300 cubic centimeters to 380 cubic centimeters.

4. The golf club head according to claim 1 wherein the club has a COR value in the range of 0.82 to 0.85.

5. A golf club head comprising:

a body having a heel end and a toe end wherein a striking plate is disposed on the body and extends from the heel end to the toe end, wherein the striking plate is composed of a forged titanium material having an exterior surface with a depth, D, of the striking plate ranging from 1.45 inches to 2.50 inches and a width, W, ranging from 2.50 inches to 4.00 inches, wherein the striking plate has an aspect ratio of at least 0.575, and a striking plate thickness, T, ranging from 0.100 inch to 0.110 inch, and wherein the body has a volume ranging from 300 cubic centimeters to 380 cubic centimeters and wherein the golf club head has a COR value ranging from 0.82 to 0.85 as measured under USGA test conditions.

* * * * *